United States Patent [19]

Mitchell et al.

[11] 4,452,688

[45] Jun. 5, 1984

[54] INTEGRATED COAL LIQUEFICATION PROCESS

[75] Inventors: Thomas O. Mitchell, Ewing; Darrell D. Whitehurst, Titusville, both of N.J.

[73] Assignee: Electric Power Research Institute, Palo Alto, Calif.

[21] Appl. No.: 182,076

[22] Filed: Aug. 28, 1980

[30] Foreign Application Priority Data

Sep. 4, 1979 [GB] United Kingdom ..... 7930607

[51] Int. Cl.[3] ..... C10G 1/06; C10G 1/00

[52] U.S. Cl. ..... 208/10; 208/8 LE

[58] Field of Search ..... 208/8 LE, 10

[56] References Cited

U.S. PATENT DOCUMENTS

| | | | |
|---|---|---|---|
| 3,598,718 | 8/1971 | Gleim et al. | 208/8 LE |
| 3,607,716 | 9/1971 | Roach | 208/8 LE |
| 3,607,717 | 9/1971 | Roach | 208/8 LE |
| 3,679,573 | 7/1972 | Johnson | 208/10 |
| 3,700,584 | 10/1972 | Johanson et al. | 208/10 |
| 3,923,634 | 12/1975 | Silvestri et al. | 208/10 |
| 4,133,646 | 1/1979 | Farcosin et al. | 208/10 X |

*Primary Examiner*—Delbert E. Gantz
*Assistant Examiner*—William G. Wright
*Attorney, Agent, or Firm*—Scully, Scott, Murphy & Presser

[57] ABSTRACT

Hydrogen conservation in solvent refining of coal is practiced and solvent compositions and adjusted to needs of two stage operation. The first stage is a short residence time dissolution in a recycle solvent rich in phenols and polyaromatics of high boiling range. The solvent is enriched for the second stage in low boiling hydrogen donors and the product of the process undergoes hydrotreating in an integrated process.

11 Claims, 1 Drawing Figure

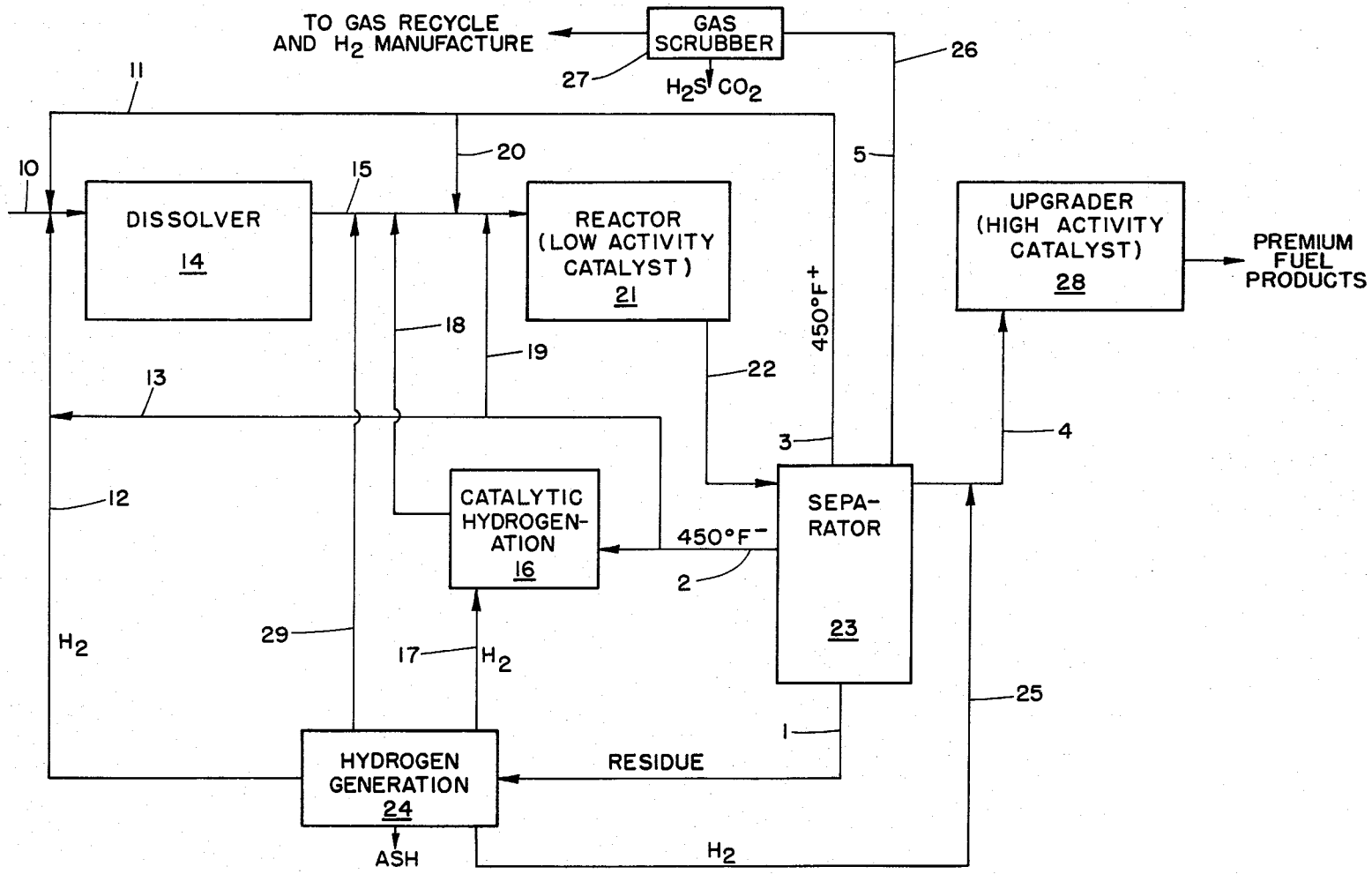
PREMIUM FUEL PRODUCTS
UPGRADER (HIGH ACTIVITY CATALYST) 28
4
25
26
5
SEPA-RATOR 23
450°F+
3
1
GAS SCRUBBER
$H_2S$ $CO_2$
22
REACTOR (LOW ACTIVITY CATALYST) 21
450°F−
2
RESIDUE
$H_2$
27
TO GAS RECYCLE AND $H_2$ MANUFACTURE
20
19
CATALYTIC HYDROGEN-ATION 16
$H_2$
18
17
HYDROGEN GENERATION 24
ASH
15
29
DISSOLVER 14
13
11
12
$H_2$
10

INTEGRATED COAL LIQUEFICATION PROCESS

FIELD OF THE INVENTION

The invention concerns improvement in solvent refining of coal whereby components of coal suitable for fuel are extracted from comminuted coal by a solvent and recovered as a low melting point mixture of reduced sulfur and mineral matter content adapted to use as fuel in conventional furnaces. In the type of operation to which the invention is directed, the solvent is derived from the product extract and applied to the raw coal feed.

BACKGROUND OF THE INVENTION

The present emphasis on the conversion of coal to substitute solid and liquid fuels has led to several alternative processes which are now being considered. The end use of the resultant converted coal will primarily determine the degree of conversion that must be accomplished and the quality of the desired product. The optimal use of the coal will depend on the specific application.

Among the many processes presently being considered is the solvent refining of coal (SRC) in which coal is treated at an elevated temperature in the presence of a hydrogen donor solvent and hydrogen gas in order to remove the mineral matter, lower the sulfur content of the coal, and to convert it into a low melting solid which can be solubilized in simple organic solvents. This SRC can also be upgraded through catalytic hydrogention to produce a liquid of higher quality. These two processes are of concern to the present invention.

Little is known at present as to the exact mechanisms by which the coal is transformed into soluble form, or of the detailed chemical structure of the soluble product or even the parent coal. It is known that many coals are easily solubilized and for others solubilization is more difficult. Some correlations have been made between the rank of the coal and ease of solubilization and product yield. A somewhat better correlation has been found with the petrography of the coal. Little is known about the relationships to product quality.

The initially dissolved coal (SRC) may have utility as a substitute clean fuel or boiler fuel; however, for substitute fuels of higher quality; specifications on viscosity, melting point, ash, hydrogen, and sulfur contents are much more stringent. Attempts to meet these specifications by operating the SRC process more severely have met with many difficulties such as low liquid yields, high hydrogen consumption, difficulty of separating unreacted residue, and excessive char formation, which often completely plugs process transfer lines and reactors.

Alternative methods of improving specifications through catalytic hydrogenation are also difficult. The problems which arise are threefold: (1) SRC components are susceptible to further condensation and may deposit as coke on catalysts used for their conversion, (2) they can also foul the catalysts by physical blockage as their size approaches the pore size of conventional catalysts, and (3) they may contain metal contaminants, and their highly polar nature (particularly nitrogenous and sulfur compounds) can lead to selective chemisorption, and thus poison the catalysts.

At the present stage of the art, the accumulated information is largely empirical, with little basis for sound extrapolation to predict detailed nature of solvent and processing conditions for optimum yield and quality of solvent refined coal. It is recognized that the poorly understood asphaltenes are probable sources of many of the problems encountered, e.g. formation of char at processing conditions conducive to efficient separation of mineral matter (ash) and sulfur from desired product at high yield.

In the process of converting coal to a low sulfur, low melting solid by use of recycled product fractions as solvent, several reaction steps occur. Generally coal is admixed with a suitable solvent recycle stream and hydrogen and the slurry is passed through a preheater to raise the reactants to a desired reaction temperature. For bituminous coal, the coal is substantially dissolved by the time it exits the preheater. Sub-bituminous coals can be dissolved but care must be exercised not to raise the temperature too high and thus promote charring.

The products exiting from the preheater are then transferred to a larger backmixed reactor where further conversion takes place to lower the heteroatom content of the dissolved coal to specification sulfur content and melting point. The geometry of this reactor is such that the linear flow rate through it is not sufficient to discharge a substantial quantity of particulate matter of a desired size. Thus the reactor volume becomes filled (at steady state) up to about 40 vol % by solids which are produced from the coal. These solids have been shown to be catalytic for the removal of heteroatoms and the introduction of hydrogen into the coal products and solvent. The products exiting the reactor are initially separated by flash distillation, which depressurizes the stream and removes gases and light organic liquids. The products are further separated (filtration, centrifugation, solvent precipitation, etc.) and the filtrate is distilled to recover solvent range material (for recycle) and the final product SRC.

The success of a process for the production of hydrogen rich liquid products from coal hinges upon maximal efficiency in hydrogen utilization. Hydrogen consumed in formation of light hydrocarbon gases requires use of part of the product or of additional coal for hydrogen production. In many of the processes presently under consideration, coal dissolution and product upgrading (usually catalytic) are generally conducted in the same reactor; conditions are optimal for neither. High temperatures and long times result in excessive gas formation and inefficient utilization of catalysts.

SUMMARY OF THE INVENTION

Because both the solvent and the coal feed to the process are highly complex chemical mixtures, the system is not susceptible of optimization by calculation of reaction kinetics. The problem is further complicated by the variability of coals and hence the variability of solvents derived from those coals.

The functions of various components of the solvent at different stages of the process have now been studied by use of typical compounds, leading to greater understanding of the reactions occuring and of the functions of various solvent components at different stages of coal dissolution and reaction of dissolved coal components. As noted above, the dissolution step is quite rapid. We have found that the solvent components most effective for dissolution are hydroaromatic and polycyclic aromatic hydrocarbons. Monocyclic phenols can also be present if higher solubility is desired. The invention contemplates a first step of short residence time, less than 5 minutes for many coals, and in the range of 0.5 to 15 minutes for coals generally in contact with a solvent rich in polycyclic aromatics. Ratios of solvent to coal on a weight basis will vary from 0.5 to 10, preferably 2 to 5, say a ratio of about 3 for most coals.

Upon dissolution, the dissolved coal fragments begin to react, with components of the solvent or with themselves in the absence of sufficient amounts of effective hydrogen donors. The reacting solution is then enriched with low boiling hydrogen donors and reacted in a second stage, suitably at lower temperature than in the dissolution step, in the presence of elemental hydrogen and a low activity hydrogenation catalyst. The stream for enrichment in low boiling hydrogen donors is derived from the effluent of the second stage as a liquid fraction containing compounds of 14 carbon atoms or less, preferably no more than 12 carbon atoms which is then hydrogenated to generate hydrogen donors, primarily tetralin and alkylated tetralins.

This selection of lower boiling polycyclic compounds for hydrogenation takes advantage of the fact that naphthalene converts to tetralin at a thermodynamic equilibrum favoring the latter hydrogen donor. The hydrogenation reaction will destroy the phenols in this fraction, but the solvent power of those compounds is not as important in the second stage because dissolution was completed to the desired extent in the first step.

The higher boiling polycyclic aromatics such as pyrene, anthracene, phenanthrene and the like are hydrogenated much more easily than is naphthalene but produce a substantially lower ratio of hydrogen donors at equilibrium.

The effluent of the second stage is then separated by known techniques to yield a solids fraction of char and ash; gases; and recycle solvent streams. The balance of low melting point hydrocarbon mixture is then hydrogenated to provide premium fuel products of the integrated process.

The invention provides a number of significant advantages. Conservation of hydrogen is important. The process of the invention results in substantial reduction in gas yield. Note that methane is 25% hydrogen by weight as compared with the 10–12% found in premium liquid hydrocarbon fuels. Because only a fraction of the recycle solvent is hydrogenated, there is no consumption of hydrogen to convert phenols in the balance of the recycle to the dissolution step with consequent loss of solvent power. Thus recycle of solvent to the dissolution step is impoved by the same expedient that conserves hydrogen. The moderate catalytic hydrogenation in the second stage reactor over a low cost disposable catalyst protects the expensive, high-activity catalyst of the finishing stage by reduction of contamination by coke-forming components, metal-organics and functional groups such as sulfur and nitrogen. Further conservation of hydrogen is realized because only the final product stream is subjected to intensive hydrogenation which will reduce phenols and other compounds which contain functional groups.

The invention thus provides an integrated system of interdependent units for hydrogen conservation while producing premium liquid fuels from coal. The nature of the improvement is discussed in detail in the paper entitled "New Liquefaction Technology By Short Contact Time Processes" pressented by T. O. Mitchell et al at the Symposium "Advanced Technology in Solid Fossil Fuels", AICHE 71st Annual Meeting, Miami Beach, Florida, Nov. 13, 1978. A copy of that paper is attached hereto and the contents thereof are incorporated herein by this reference.

DESCRIPTION OF THE DRAWING

The single FIGURE of the annexed drawing is a diagrammatic flow sheet illustrative of the integrated coal liquefaction process involving short contact time dissolution.

The coal is dissolved in a recycle solvent in a short contact time dissolver with minimal hydrogen consumption or change in coal or solvent properties.

The solvent at this point should contain significant quantities of polyaromatics and optionally phenols. No catalyst other than the inherent coal mineral matter is used. The entire dissolver effluent then passes to a reactor containing a relatively inexpensive disposable or regenerable low activity catalyst. In this reactor there is some molecular weight reduction, some hydroaromatic formation, some phenol dehydroxylation, some desulfurization, and extensive removal of coke precursors and dissolved organometallics. The solvent should be a better hydrogen donor than that in the dissolver.

The catalyst may be and is preferably disposable. The principal purposes of this stage are to generate solvent suitable for use in the dissolver and to protect subsequent catalysts from severe poisoning and coke deposition.

The separator is preferentially a combination of a critical solvent deasher and stills or flash evaporators. It produces the various recycle streams, residue for $H_2$ manufacture, and a feed to the upgrading step.

The final upgrading is done with a high activity conventional hydrotreating catalyst such as Co-Mo/$Al_2O_3$, NiMo/$Al_2O_3$, NiW/$SiO_2$-$Al_2O_3$-$TiO_2$, etc., in fixed or fluidized bed continuous operation, to produce a premium fuel of high hydrogen content. Long catalyst life is assured by the prior removal of unreacted coal, char, the worst coke precursors and organometallics.

This process optimizes the conditions (time, temperature, and solvent) in the dissolution and catalytic upgrading steps, providing for greater efficiency and more flexibility in product slate.

The separate low severity reaction step placed between the dissolver and final upgrading step generates solvent suitable for the dissolver and protects the subsequently used high activity catalyst. The separation of the product of dissolution plus mild upgrading into four specific streams for specific uses, furnishes attractive possibilities for the ways in which the streams particularly 2 and 3 may be recycled.

According to the embodiment of the invention shown in the single figure of the annexed drawing, liquefaction is conducted for optimal production of several fractions:

1. This is substantially the solid coal residue containing char, unreacted coal, and mineral matter, and small amounts of liquids that remain with the solids after separation. This stream is used for $H_2$ manufacture and process heat. Depending on the mode of operation it may also contain some disposable catalyst.
2. This is a light and low functionality recycle containing preferably $C_{12}$-hydroaromatics and aromatics and monoaromatic phenols. A portion may be recycled directly to the dissolver or to the reactor, and the latter portion may be catalytically hydrogenated before introduction to the reactor.

3. This is a heavier boiling more functional fraction containing some hydroaromatics but substantially polyaromatics and phenol's components.
4. This is those portions of streams 2 and 3 not needed for recycle, and in addition may contain soluble products higher boiling or more functional than stream 3.
5. This is light hydrocarbon gases $H_2$, $CO_2$, $H_2S$, etc., which are treated to remove $H_2S$ and $CO_2$ then recycled and/or used for $H_2$ manufacture.

A portion of any of these streams, or of the effluent from the dissolver or reactor, can of course be taken as product as well. There can be an external recycle around either the dissolver or the reactor.

DESCRIPTION OF PREFERRED EMBODIMENTS

Referring again to the annexed drawing, crushed coal enters the system at line 10 and is mixed with a portion of recycle stream 3 of solvent derived in the process and boiling above about 450° F. That stream is rich polycyclic hydroaromatic and polycyclic hydrocarbons and may contain phenolic components. Stream 3 is not hydrogenated, but passes by line 11 to mix with the coal. By using the higher boiling fraction of the solvent without hydrogenation, the operator preserves the phenol contact which has high solvent power for coal components. We have found that polycyclic aromatics of more than three rings are readily converted to hydrogen donors in the presence of the metal components of coal. There is evidence that pyrene may form hydrogen donors in the presence of hydrogen without a catalyst. Thus separate hydrogenation of the heavy recycle solvent is not only unnecessary, but is wasteful of hydrogen to convert phenols to hydrocarbons, with consequent loss of the phenol solvent component.

Hydrogen from line 12 is preferably added to the mixture of coal and heavy recycle solvent and a portion of the light recycle stream 2, without hydrogenation, may also be added from line 13, thus providing single ring phenols. The mixture is introduced to a dissolver 14 where it is held for a short residence time, variable with nature of the coal, in the range of 0.5 to 15 minutes at temperatures below 880° F., generally in the range of 700–860° F., preferably 750–850° F. Under pressure sufficient to maintain a liquid hydrocarbon phase, coal constituents are dissolved in the solvent. The solvent, in addition to polycyclic hydrocarbons and phenols which promote dissolution, will contain hydrogen donor compounds generated in the reactor hereinafter discussed. Polycyclic aromatics of three or more condensed aromatic rings will generate hydrogen donors in the presence of hydrogen and coal derived solids, thus shuttling hydrogen to the reactive coal fragments resulting from dissolution.

Following the short residence time dissolution in dissolver 14, the mixture of coal residue, solution of coal components in recycle solvent and hydrogen either carried through the dissolver or enriched through line 29 is mixed in line 15 with hydrogenated light recycle solvent from stream 2. Stream 2 is constituted by a liquid fraction from the process boiling preferably below about 450° F. and containing compounds of 12 or less carbon atoms, including phenols, naphthols and other compounds having functional groups, mono- bicyclic aromatic hydrocarbons and hydroaromatics. A portion of stream 2 is hydrogenated under conditions to generate hydrogen donors from bicyclic condensed ring aromatics e.g. naphthalene and alkyl naphthalenes are converted to tetralin and alkyl tetralins. Some phenols will be converted to aromatic hydrocarbons under these conditions, but this is not a disadvantage since high solvent power becomes much less important after the dissolution step in dissolver 14.

Stream 2 may be of broader boiling range to include compounds of up to about 14 carbon atoms, say a cut point between streams 2 and 3 in the range of 525°–550° F. In such case, stream 2 will contain more highly alkylated naphthalenes and hydrophenanthrenes and thus contain more potential hydrogen donors. However, it will also contain increased amounts of anthracene, phenanthrene which are preferred to be in stream 3 for supply to dissolver 14. Thus, although the invention in its broader aspects contemplates a stream 2 containing compounds of up to 14 carbon atoms, it is preferred that it contain no substantial quantity of compounds having more than 12 carbon atoms.

The portion of stream 2 for hydrogenation is reacted in reactor 16 with elemental hydrogen from line 17 over a suitable catalyst such as cobalt-molybdenum on alumina to approach the thermodynamic equilibrium value of tetralins in the effluent at line 18 for mixture with dissolver effluent in line 15. Unhydrogenated portions of streams 2 and 3 may also be added by lines 19 and 20, respectively, as may be found desirable to promote efficiency of the system.

The mixture of dissolver effluent with hydrogenated stream 2 passes to reactor 21 which contains a low activity hydrogenation catalyst. For some coals, such as those containing substantial amounts of pyrites, the coal solids may be adequate catalyst for reactor 21. Usually, it is preferred to provide a low cost, disposable or regenerable catalyst of low activity such as manganese nodules, bog iron or the like. Such catalysts are described in detail in copending application Ser. No. 945,281, filed Sept. 25, 1978, the entire contents of which are incorporated herein by this reference.

Conditions in reactor 21 are adjusted to reduce sulfur and nitrogen content of the coal liquids and remove substantial amounts of the metals contained in metal organics at least to an extent to provide long useful life of the catalyst used for finishing steps of hydrotreating to provide premium fuel products from the system. In general, the temperatures will be in the same general range as those in dissolver 14, but usually somewhat lower. High temperatures promote formation of gaseous hydrocarbons at excessive consumption of hydrogen. The reactor 21 is therefore operated at the lowest temperature which will accomplish the purpose of stabilizing the coal liquids to provide recycle solvents and product for catalytic hydrogenation upgrading. The low activity disposable catalysts will be chosen such that monocyclic phenols are not substantially converted to hydrocarbons at the conditions of reactor 21. Hydrogen provided with the effluent of dissolver 14 and hydrogen donors in the added streams will usually suffice for the needs of reactor 21, but additional elemental hydrogen may be added to this reactor as needed by means of line 29.

Residence time in reactor 21 will be longer than that in dissolver 14, up to about one hour or longer. The effluent of reactor 21 at line 22 is liquid at the conditions employed and constituted by coal derived organic compounds of reduced sulfur, nitrogen and metal content, together with normally gaseous by-products and suspended solids comprising char and ash.

The stream in line 22 is passed to separator facility 23 which may comprise the usual fractionation equipment and filter, centrifuges or the like for separating suspended solids. For example, the separations may be conducted with the aid of solvents as described in U.S. Pat. Nos. 3,607,716 and 3,607,717.

By whatever specific combination of means, effluents from separator 23 provide five streams as numbered on the annexed drawing.

Stream 1 contains the suspended solid matter from the effluent of reactor 21, including combustible char and incombustible ash and in some modes, may contain disposable catalyst. That residue is transferred to hydrogen generation equipment 24 which supplies hydrogen to dissolver 14, catalytic hydrogenation 16 and the final upgrader presently to be described by lines 12, 17 and 25, respectively.

Stream 2 is a low boiling liquid fraction from which normally gaseous components have been removed. It is characterized by low functionality and contains hydroaromatics, aromatics and primarily mono aromatic phenols of not more than 14 carbon atoms, preferably 12 or less. The primary use of stream 2 is hydrogenation to supply maximum quantities of low boiling hydrogen donors to the reactor 21. Portions may be recycled directly to dissolver 14 and to reactor 21.

Stream 3 for recycle without hydrogenation is rich in functional groups and polyaromatics having high solvent power and constitutes the principal solvent for the dissolver 14. It contains some hydroaromatics, but is constituted largely by polyaromatics and phenol components. The top distillation point of stream 3 (end point) will be a function of the capability of the separation equipment. End points in the neighborhood of 950° F. are presently attainable.

The normally gaseous components of the effluent from reactor 21, say those having boiling points below about 70° F. are removed from the separator 23 as stream 5 in line 26. That stream is scrubbed, as by a caustic solution, in gas scrubber 27 and the gas free of acidic components is then used for fuel, generation of hydrogen and the like.

Stream 4 is essentially constituted by liquid components of the effluent of reactor 21 not required for recycle streams 2 and 3 and corresponds in composition roughly to a blend of those streams 2 and 3. It is thus of reduced sulfur, nitrogen and metal content and has reduced level of reactive coke-forming constitutents. It is well suited to upgrading by hydrogenation over a high activity (expensive) hydrogenation catalyst. Thus reactor 21 serves as a guard chamber to protect the expensive finishing catalyst presently to be described against premature deactivation, but only at a hydrogen consumption rate actually required to avoid char formation and retain phenols and polycyclic aromatics in recycle streams 2 and 3. The reduced temperature of reactor 21 further conserves hydrogen by reduced formation of hydrocarbon gases.

Stream 4 plus hydrogen from line 25 are supplied to the final upgrading reactor 28 for reaction over high activity hydrogenation catalyst at conventional conditions for hydrotreating to produce premium quality liquid fuel. The catalyst in reactor 28 is any of the high activity hydrotreating catalysts used for that purpose in petroleum refinery practice, such as combinations of cobalt or nickel with molybdenum on alumina or nickel plus tungsten on silica-alumina modified by titania. As is recognized in that art, the reactions occuring are desulfurization, denitrogenation, conversion of phenols to hydrocarbons, demetalization and saturation. To some extent these reactions have proceeded in reactor 21, but the finishing reactions are conducted in reactor 28 whereby each of these catalyst stages operates (and consumes hydrogen) only in the manner best suited to the purpose it serves.

The integrated process of the drawing provides optimal management of phenols, polyaromatic hydrocarbons and hydrogen donors. Solvent quality and balance of solvent and hydrogen donor functions are achieved at the dissolver 14 and reactor 21.

We claim:

1. A process for solvent refining of coal at reduced hydrogen consumption and reduced production of normally gaseous hydrocarbons which comprises mixing finely divided coal with hydrogen and a solvent derived in the process which contains substantial quantities of polycyclic aromatic hydrocarbons and phenols during a residence time in a first stage less than about 15 minutes at a temperature of less than about 880° F. to thereby dissolve components of the coal in the solvent, adding to the resultant solution a low boiling hydrogen donor stream derived in the process, reacting the mixture so produced in a second stage under hydrogen pressure for a residence time longer than and a temperature lower than those in the said first stage, separating from the product of said second stage a first fraction containing solids separated from said product, a second fraction consisting essentially of normally liquid components of said product having fourteen or less carbon atoms, hydrogenating a portion of said second fraction under severe conditions to convert monocylic phenols to hydrocarbons and convert polycyclic aromatics to hydrogen donor hydroaromatics, recycling the hydrogenated portion of said second fraction to said second stage as said low boiling hydrogen donor stream, a third fraction containing liquid components of said product which are higher boiling than said second fraction, recycling at least a portion of said third fraction to said first stage as said solvent derived in the process, a fourth fraction constituted by liquid components of said product and corresponding substantially in composition to a mixture of said second and third fractions, subjecting said fourth fraction to hydrotreating under conditions to substantially remove hydroxyl and other functional groups and yield a premium quality fuel and a fifth fraction constituted by normally gaseous components of said product.

2. A process according to claim 1 wherein said residence time in said first stage is about 0.5 to about 5 minutes.

3. A process according to claim 1 wherein said temperature in said first stage is in the range of about 700°-880° F.

4. A process according to claim 1 wherein said temperature in said first stage is in the range of 750°-850° F.

5. A process according to claim 1 wherein said second stage contains a low activity hydrogenation catalyst such that, at the conditions of the said second stage, a substantial amount of phenols is preserved.

6. A process according to claim 1 wherein said second fraction consists essentially of compounds having not more than twelve carbon atoms.

7. A process according to claim 1 wherein said temperature in said first stage is in the range of 750°-850° F.

8. In a process for solvent refining of coal by mixing finely divided coal with hydrogen and a solvent derived in the process which contains substantial quantities of phenols and polycyclic aromatic hydrocarbons, reacting the resultant mixture in a first stage during a residence time less than about 15 minutes at a temperature less than about 880° F. to thereby dissolve components of the coal in said solvent, transferring the product of said first stage reaction to a second stage and reacting the same under hydrogen pressure in said second stage for a residence time longer and a temperature lower than in said first stage, separating the product of said second stage into a gas friction; a solids fraction and a liquid fraction, recycling a portion of said liquid fraction as the said solvent derived in the process for admixture with coal as aforesaid and hydrogenating a portion of said liquid fraction to provide a fuel product of the process;

the improvement resulting in reduced hydrogen consumption by the process and reduced production of normally gaseous hydrocarbons of high hydrogen content which comprises conducting said second stage reaction in the presence of a low activity hydrogenation catalyst under conditions such that monocyclic phenols are not substantially converted to hydrocarbons, separating from said liquid fraction a light stream boiling below about 450° F., hydrogenating at least a portion of said light stream under conditions to approach the thermodynamic equilibrium for tetralin, adding the resultant hydrogenated portion of said light stream to said second stage, separating from said liquid fraction a heavy stream boiling above about 450° F., recycling a portion of said light stream and said heavy stream as said solvent derived in the process for admixture with coal as aforesaid, and upgrading a portion of said liquid fraction by catalytic hydrogenation to increase the hydrogen content thereof and remove functional groups.

9. A process according to claim 8 wherein said residence time in said first stage is about 0.5 to about 5 minutes.

10. A process according to claim 8 wherein said temperature in said first stage is in the range of about 700°-880° F.

11. A process according to claim 8 wherein said light stream consists essentially of compounds having not more than twelve carbon atoms.

* * * * *